US008118628B2

(12) United States Patent
Hagi

(10) Patent No.: US 8,118,628 B2
(45) Date of Patent: Feb. 21, 2012

(54) MOUNT STRUCTURE OF OUTBOARD MOTOR

(75) Inventor: Tomohiro Hagi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 166 days.

(21) Appl. No.: 12/774,741

(22) Filed: May 6, 2010

(65) Prior Publication Data

US 2011/0104964 A1 May 5, 2011

(30) Foreign Application Priority Data

Oct. 30, 2009 (JP) ..... 2009-251058

(51) Int. Cl.
*B63H 21/30* (2006.01)

(52) U.S. Cl. ..... 440/52; 248/640

(58) Field of Classification Search ..... 440/52, 440/53; 248/640, 641, 642, 643
See application file for complete search history.

(56) References Cited

U.S. PATENT DOCUMENTS

| | | | | |
|---|---|---|---|---|
| 5,180,319 | A * | 1/1993 | Shiomi et al. | 440/52 |
| 5,511,997 | A * | 4/1996 | Yoshida | 440/52 |
| 6,048,236 | A | 4/2000 | Natsume | |
| 6,354,893 | B1 | 3/2002 | Sato | |

FOREIGN PATENT DOCUMENTS

| | | | |
|---|---|---|---|
| JP | 3-28097 | A | 2/1991 |
| JP | 10-119891 | A | 5/1998 |
| JP | 2001-71994 | A | 3/2001 |

* cited by examiner

*Primary Examiner* — Lars A Olson
(74) *Attorney, Agent, or Firm* — Keating & Bennett, LLP

(57) ABSTRACT

A mount structure of an outboard motor includes a first member, a second member, a buffer member, a sandwiching member, and a second elastic member. A propulsive force generated by a propeller of the outboard motor is applied to the first member. The second member is arranged such that the propulsive force is transmitted to the second member via the first member. The buffer member includes an outer sleeve fixed to the first member, an inner sleeve inserted in the outer sleeve, a first elastic member fixed to the outer sleeve and the inner sleeve. The sandwiching member is arranged to sandwich the second member and the inner sleeve in a direction of action of the propulsive force. The second elastic member is fixed to the first member. The second elastic member is opposed to the sandwiching member across a gap in the direction of action.

7 Claims, 6 Drawing Sheets

MOUNT STRUCTURE OF OUTBOARD MOTOR

BACKGROUND OF THE INVENTION

1. Field of the Invention

The present invention relates to a mount structure of an outboard motor.

2. Description of the Related Art

An outboard motor according to a prior art is described in, for example, U.S. Pat. No. 6,048,236. This outboard motor has a mount structure for attaching an upper case positioned below an engine cover to a hull. This mount structure includes a bracket, a sleeve, a bolt and a nut, a rubber collar, a rubber cap, an upper case, and a housing. The bracket has a through hole penetrating through the bracket forward and rearward. The sleeve is arranged along the front-rear direction at the rear of the bracket. The inner periphery of the sleeve communicates with the through hole of the bracket. The bolt is inserted in the inner periphery of the sleeve and the through hole of the bracket from the sleeve side (rear side). The nut is attached to an end portion of a shaft portion of the bolt projecting from the sleeve. Accordingly, the bracket and the sleeve are fastened together.

The rubber collar has a tubular shape. The collar is fixed to the sleeve so as to surround the sleeve. The collar is held on the upper case and the housing while being sandwiched by the upper case and the housing from the left and right. Accordingly, the bracket and the upper case are joined via the collar and the sleeve. The housing holds the collar in cooperation with the upper case, and covers the head portion of the bolt from the lateral side. The head portion of the bolt is opposed to a portion of the upper case and a portion of the housing in the front-rear direction across a gap. The rubber cap is covered on the head portion of the bolt. The cap has an elastic modulus higher than that of the rubber collar. The end surface of the cap is opposed to a portion of the upper case and a portion of the housing in the front-rear direction across a gap.

In the outboard motor according to the prior art described above, a propulsive force generated by a propeller is applied to the upper case. When the propulsive force generated by the propeller is small, the propulsive force is transmitted to the bracket from the upper case via the collar and the sleeve. At this time, vibration of the upper case is absorbed mainly by the rubber collar. On the other hand, when a forward propulsive force generated by the propeller is great, the collar is elastically deformed and the distance in the front-rear direction between the head portion of the bolt and the upper case and housing becomes shorter. Accordingly, the cap comes into contact with the upper case and the housing, and the propulsive force is transmitted to the bracket from the upper case via the cap and the sleeve. Then, when the propulsive force becomes small, the cap separates from the upper case and the housing again.

SUMMARY OF THE INVENTION

The inventor of preferred embodiments of the present invention described and claimed in the present application conducted an extensive study and research regarding a mount structure of an outboard motor, such as the one described above, and in doing so, discovered and first recognized new unique challenges and previously unrecognized possibilities for improvements as described in greater detail below.

That is, in the outboard motor according to the prior art described above, when the propulsive force generated by the propeller becomes greater, the cap comes into contact with the upper case and the housing. Accordingly, the propulsive force applied to the upper case is efficiently transmitted to the bracket. Further, the upper case and the housing are protected from the head portion of the bolt by the cap, so that the upper case and the housing are prevented from being damaged. However, if a great propulsive force is repeatedly applied to the upper case, contact and separation between the cap and the upper case and housing are repeated, and a load is repeatedly applied to the cap. The bolt is removed for maintenance, so that the head portion of the bolt and the cap are not fixed to each other normally. Therefore, the cap may come off the bolt. If heat generated by the outboard motor is transmitted to the cap, the cap expands and easily comes off the bolt.

To prevent the cap from coming off the bolt, a method is possible in which the space accommodating the cap is filled with a high-elasticity material with an elastic modulus equivalent to that of the cap. However, according to this method, the joined state between the upper case and the bracket cannot be switched according to the rotation speed of the engine. In detail, in the outboard motor according to the prior art described above, vibration of the engine is transmitted to the upper case. When the engine rotates at a low speed, the frequency of vibration of the engine is comparatively low. This low-frequency vibration is transmitted to the hull to which the outboard motor is attached, which is not desirable. Therefore, when the engine rotates at a low speed, absorption of vibration is important.

On the other hand, when the engine rotates at a high speed, the vibration frequency of the engine is comparatively high. In this case, vibration caused by waves on the water is mainly transmitted to the hull, which is not desirable. Therefore, efficient transmission of the propulsive force becomes more important than the absorption of vibration. However, according to the method in which the space accommodating the cap is filled with the high-elasticity material, the upper case and the bracket are always joined via the high-elasticity material, so that the joined state between the upper case and the bracket cannot be switched according to the rotation speed of the engine.

In order to overcome the previously unrecognized and unsolved challenges described above, a preferred embodiment of the present invention provides a mount structure of an outboard motor including a first member, a second member, a buffer member, a sandwiching member, and a second elastic member. The first member is arranged such that a propulsive force generated by a propeller of the outboard motor is applied to the first member. The second member is arranged such that the propulsive force is transmitted to the second member via the first member. The buffer member includes a tubular outer sleeve, a tubular inner sleeve, and a first elastic member. The outer sleeve is fixed to the first member. The inner sleeve is inserted in the outer sleeve. The inner sleeve is arranged in a direction of action of the propulsive force with the second member. The first elastic member is fixed to an inner peripheral surface of the outer sleeve and an outer peripheral surface of the inner sleeve. The sandwiching member includes a pair of sandwiching portions arranged to sandwich the second member and the inner sleeve in the direction of action of the propulsive force, and a first end portion positioned on the inner sleeve side. The second elastic member has an elastic modulus higher than an elastic modulus of the first elastic member. The second elastic member is fixed to the first member. The second elastic member is opposed to the first end portion of the sandwiching member across a gap in the direction of action of the propulsive force.

According to this arrangement, the buffer member includes the tubular outer sleeve, the tubular inner sleeve inserted in the outer sleeve, the first elastic member fixed to the inner peripheral surface of the outer sleeve and the outer peripheral surface of the inner sleeve. The outer sleeve is fixed to the first member. The inner sleeve and the second member are sandwiched by a pair of sandwiching portions. Accordingly, the inner sleeve and the second member are joined to each other. Therefore, the first member and the second member are joined via the first elastic member. Also, the second elastic member having the elastic modulus higher than that of the first elastic member is fixed to the first member. Therefore, the propulsive force generated by the propeller of the outboard motor is transmitted from the first member to the second member via the first elastic member and/or the second elastic member.

In detail, the second elastic member is opposed to the first end portion of the sandwiching member on the inner sleeve side across a gap in the direction of action of the propulsive force. Therefore, when the propulsive force applied to the first member is small (for example, when the engine rotates at a low speed), in a state in which the second elastic member and the first end portion of the sandwiching member are separated from each other, the propulsive force is transmitted from the first member to the second member via the first elastic member. Also, at this time, vibration of the first member (for example, vibration generated by the rotation of the engine) is mainly absorbed by the first elastic member.

On the other hand, when the propulsive force applied to the first member is great (for example, when the engine rotates at a high speed), elastic deformation of the first elastic member in the direction of action increases. Therefore, the first end portion of the sandwiching member and the second elastic member come closer to or separate from each other. For example, in a case in which the first end portion of the sandwiching member and the second elastic member are arranged to come closer to each other, when the deformation amount of the first elastic member reaches a predetermined value, the sandwiching portion and the second elastic member come into contact with each other. Then, the propulsive force generated by the propeller is transmitted via the first elastic member as described above, and additionally transmitted from the first member to the second member via the second elastic member, the sandwiching member, and the buffer member.

Thus, according to this arrangement, when the propulsive force is small, the propulsive force is transmitted from the first member to the second member via the first elastic member. On the other hand, when the propulsive force is great, the propulsive force is transmitted from the first member to the second member via the second elastic member in addition to the first elastic member. Therefore, in the state in which the propulsive force is great, the ratio of the propulsive force to be absorbed by the first elastic member to the propulsive force generated by the propeller is smaller than in the state in which the propulsive force is small. Therefore, the propulsive force is efficiently transmitted. The first member is protected by the second elastic member, so that the first member is prevented from being damaged. The second elastic member is fixed to the first member, so that the risk of the second elastic member coming off of the first member is very small. Therefore, the above-described effect is reliably obtained for a long period of time.

The second elastic member may include a pair of front-rear engagement portions, a pair of left-right engagement portions, and a pair of up-down engagement portions. The pair of front-rear engagement portions may be arranged to engage with the first member from the front side and the rear side. The pair of left-right engagement portions may be arranged to engage with the first member from the left side and the right side. The pair of up-down engagement portions may be arranged to engage with the first member from the upper side and the lower side.

According to this arrangement, the engagements between the respective front-rear engagement portions and the first member restrict the movement in the front-rear direction of the second elastic member. The engagements between the respective left-right engagement portions and the first member restrict the movement in the left-right direction of the second elastic member. The engagements between the up-down engagement portions and the first member restrict the movement in the up-down direction of the second elastic member. Therefore, the second elastic member is restricted from moving in the front-rear, left-right, and up-down directions with respect to the first member. Accordingly, the second elastic member is reliably fixed to the first member.

The second elastic member may have a shape and configuration so as to extend along an inner surface of the first member.

According to this arrangement, the second elastic member is arranged along the inner surface of the first member, so that engagement between the second elastic member and the first member restricts the second elastic member from moving with respect to the first member. Accordingly, the second elastic member is more reliably fixed to the first member.

The second elastic member may include an opposed portion arranged to be opposed to the first end portion of the sandwiching member, and a fixed portion fixed to the first member.

According to this arrangement, by fixing the fixed portion of the second elastic member to the first member, the entire second elastic member is fixed to the first member. Accordingly, the second elastic member is prevented from coming off the first member. The second elastic member is divided into the portion (opposed portion) to be opposed to the first end portion of the sandwiching member and the portion (fixed portion) to be fixed to the first member, so that the second elastic member is easily manufactured. In detail, high dimensional accuracy is not required for the fixed portion as long as it is arranged so as to fix the opposed portion at a predetermined position. Therefore, the second elastic member is easily manufactured.

The first member may include a supporting portion arranged to be opposed to the first end portion of the sandwiching member across the second elastic member. The second elastic member may include a supported portion arranged to be supported by the supporting portion.

According to this arrangement, the supported portion of the second elastic member is supported by the supporting portion of the first member, so that when the second elastic member and the first end portion of the sandwiching member come into contact with each other, the second elastic member is sandwiched by the first member and the first end portion of the sandwiching member. In this state, the propulsive force is transmitted from the first member to the first end portion of the sandwiching member via the second elastic member. Accordingly, the propulsive force is reliably transmitted from the first member to the first end portion of the sandwiching member. Therefore, the propulsive force generated by the propeller is efficiently transmitted.

The second elastic member may be made integrally of an elastic material, for example. According to this arrangement, the production efficiency of the second elastic member is increased.

The first member may include an upper case and a housing. The upper case may be arranged such that the propulsive force is applied to the upper case. The housing may be attached to the upper case such that the buffer member is covered by the housing. The second elastic member may be fixed to the housing. According to this arrangement, as compared to a case in which the second elastic member is fixed to the upper case, attachment of the housing to the upper case is easy.

Other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
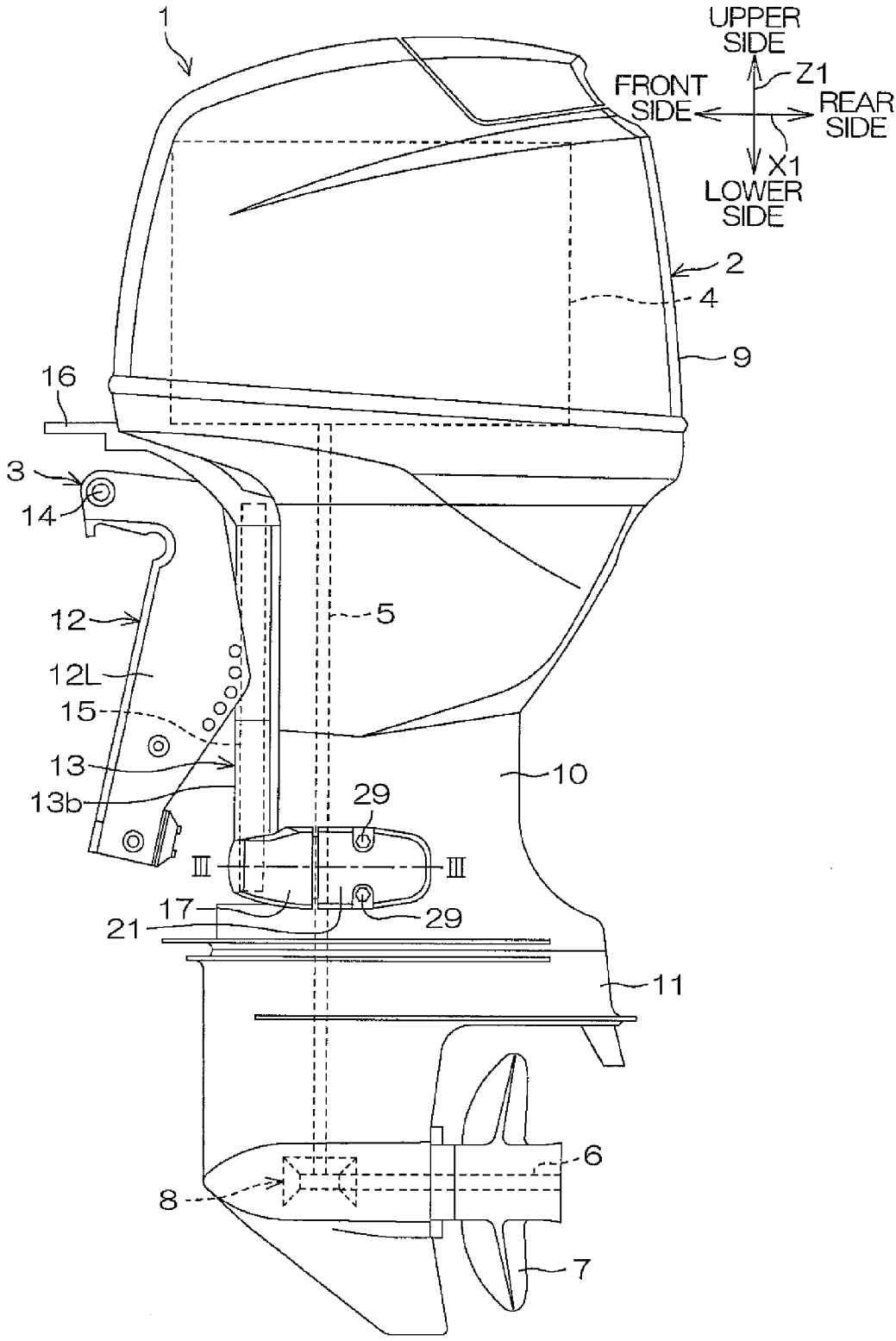
FIG. 1 is a side view of an outboard motor according to a preferred embodiment of the present invention.
Figure 2:
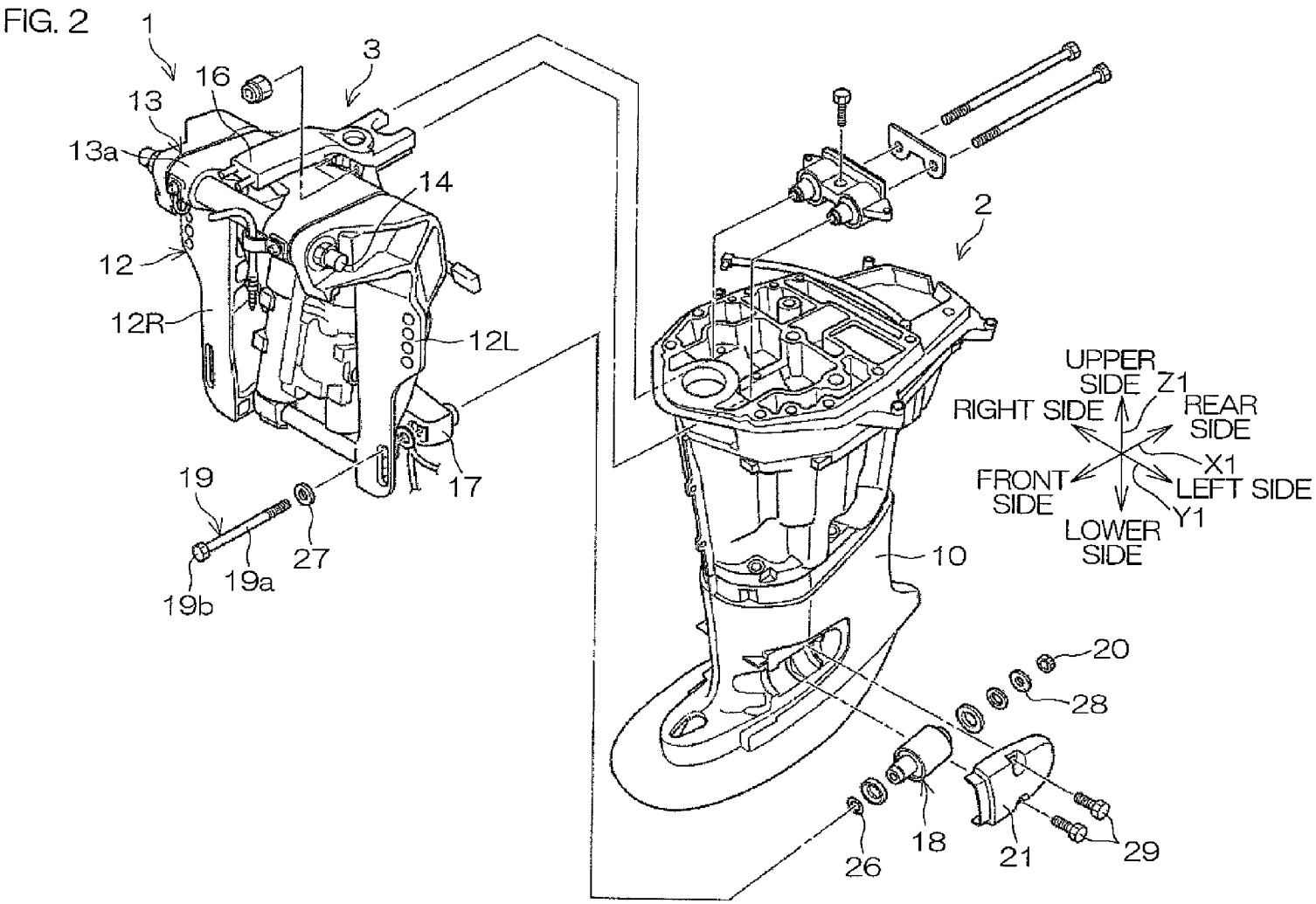
FIG. 2 is an exploded perspective view of the outboard motor according to a preferred embodiment of the present invention.

FIG. 1 is a side view of an outboard motor 1 according to a preferred embodiment of the present invention. Also, FIG. 2 is an exploded perspective view of the outboard motor 1. In FIG. 1, the outboard motor 1 is in a standard posture. The standard posture is a posture of the outboard motor 1 in which the rotation axis of the propeller 7 is horizontal. The front-rear, left-right, and up-down directions in the description given below are the front-rear, left-right, and up-down directions when the outboard motor 1 is in a standard posture.

The outboard motor 1 includes an outboard motor main body 2, and an attaching mechanism 3. The outboard motor main body 2 is attached to a hull not shown by the attaching mechanism 3. As shown in FIG. 1, the outboard motor main body 2 includes an engine 4, a drive shaft 5, a propeller shaft 6, a propeller 7, and a gear mechanism 8. The engine 4 is housed inside an engine cover 9. Also, the drive shaft 5, the propeller shaft 6, and the gear mechanism 8 are housed in an upper case 10 and a lower case 11. The upper case 10 is arranged below the engine cover 9. The lower case 11 is arranged below the upper case 10.

The drive shaft 5 is arranged along the up-down direction Z1 below the engine 4. The drive shaft 5 is rotated by the engine 4. The propeller shaft 6 is arranged along the front-rear direction X1 below the drive shaft 5. The gear mechanism 8 joins the lower end portion of the drive shaft 5 and the front end portion of the propeller shaft 6 to each other. The rotation of the drive shaft 5 is transmitted to the propeller shaft 6 by the gear mechanism 8. The propeller 7 is integrally joined to the rear end portion of the propeller shaft 6. The propeller 7 is arranged outside the lower case 11. A propulsive force for propelling the hull forward and reverse is generated by the rotation of the propeller 7. The propulsive force generated by the propeller 7 is a force in the front-rear direction X1. The propulsive force generated by the propeller 7 is applied to the upper case 10 via the lower case 11.

The attaching mechanism 3 includes a clamp bracket 12, a swivel bracket 13, a tilt shaft 14, a steering shaft 15, a steering bracket 16, and a lower bracket 17. As shown in FIG. 2, the clamp bracket 12 has a right bracket 12R and a left bracket 12L arranged on the right and left sides while being spaced from each other. The right and left brackets 12R and 12L are fixed to the stern of the hull not shown. The outboard motor 1 is attached to the hull by fixation of the right and left brackets 12R and 12L to the hull.

Also, the swivel bracket 13 includes an interposed portion 13*a* (see FIG. 2), and a tubular portion 13*b* (see FIG. 1) joined to the interposed portion 13*a*. As shown in FIG. 2, the interposed portion 13*a* is arranged between the right and left brackets 12R and 12L. The interposed portion 13*a* is joined to the right and left brackets 12R and 12L via the tilt shaft 14 arranged along the left-right direction Y1. The swivel bracket 13 is joined to the clamp bracket 12 turnably around the central axis of the tilt shaft 14. The outboard motor main body 2 is tilted such that the front surface of the outboard motor main body 2 is directed downward by turning the swivel bracket 13 in the up-down direction with respect to the clamp bracket 12. Accordingly, the outboard motor main body 2 is tilted up.

The tubular portion 13*b* is arranged along the up-down direction Z1 at the rear of the interposed portion 13*a*. The steering shaft 15 is inserted through the tubular portion 13*b*. The steering shaft 15 is arranged rotatably around the central axis of the steering shaft 15 with respect to the tubular portion 13*b*. The upper end portion and the lower end portion of the steering shaft 15 project from the upper end and the lower end of the tubular portion 13*b*. The upper end portion of the steering shaft 15 is fixed to an upper portion of the outboard motor main body 2 via the steering bracket 16. Also, the lower end portion of the steering shaft 15 is fixed to a lower portion of the outboard motor main body 2 via a lower bracket 17. The outboard motor main body 2 is turned to the left or right around the central axis of the steering shaft 15 when the steering bracket 16 is operated to the left or right. Accordingly, the hull is steered.

Thus, the outboard motor main body 2 is joined to the attaching mechanism 3 at the upper and lower portions. In detail, as shown in FIG. 2, the upper portion of the outboard motor main body 2 is fixed to the steering bracket 16 at two points on the left and right of the center of the outboard motor main body 2 in the left-right direction Y1. The lower portion of the outboard motor main body 2 is fixed to the lower bracket 17 at two points on the left and right of the center of the outboard motor main body 2 in the left-right direction Y1. Specifically, the outboard motor 1 includes two mount structures (upper-side and lower-side mount structures) for mounting the outboard motor main body 2 to the attaching mechanism 3. A propulsive force generated by the propeller 7 is transmitted to the steering bracket 16 and the lower bracket 17 of the attaching mechanism 3 via the two mount structures. The lower bracket 17 is an example of a second member according to a preferred embodiment of the present invention.

Next, the lower-side mount structure of the outboard motor 1 will be described with reference to FIG. 2 and FIG. 3. In the lower-side mount structure, the left structure and the right structure are the same (symmetrical), so that only the left structure of the lower-side mount structure will be described hereinafter.

Figure 3:
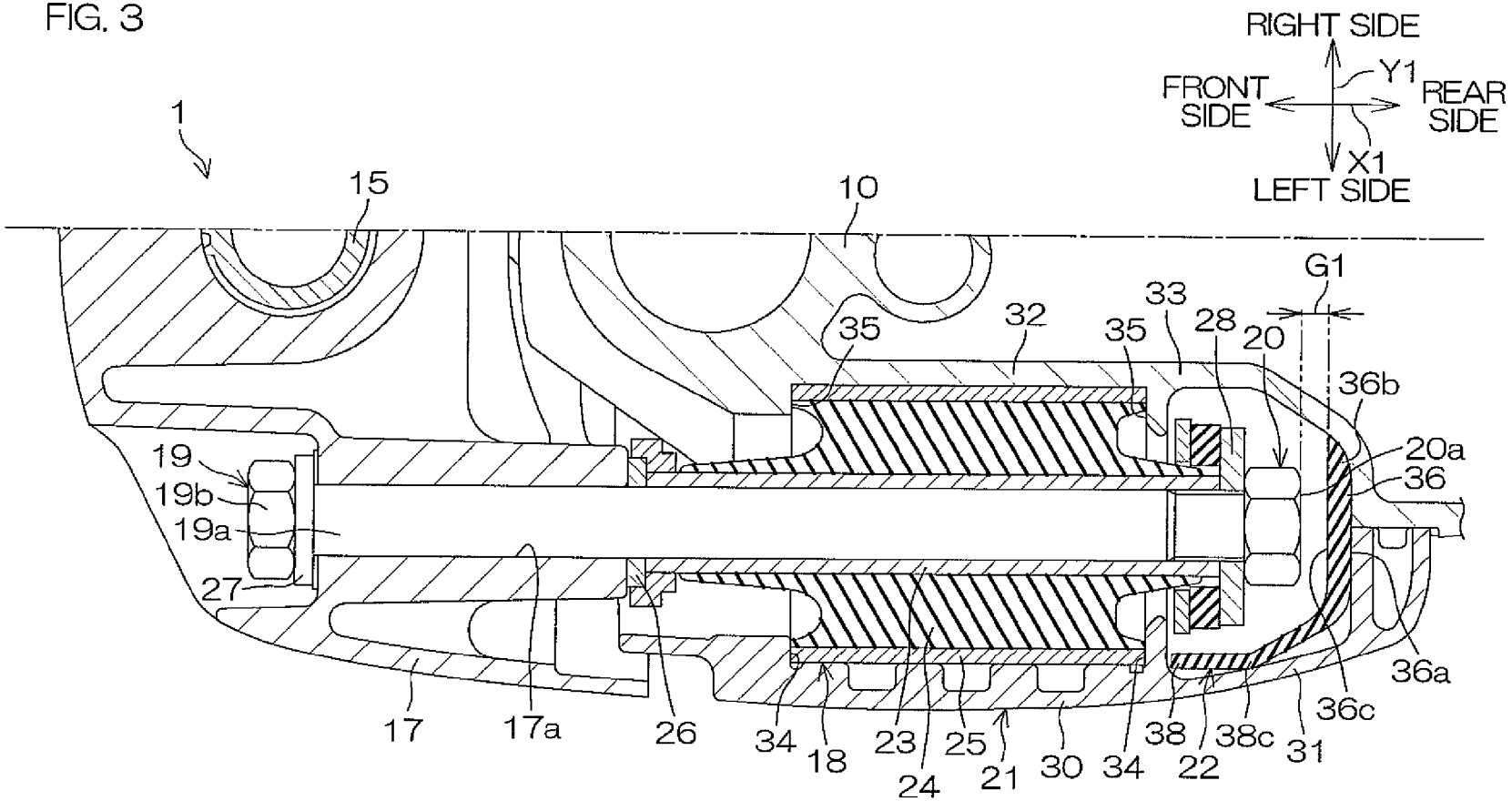
FIG. 3 is a sectional view of the outboard motor according to a preferred embodiment of the present invention along the III-III line of FIG. 1.

FIG. 3 is a sectional view of the outboard motor 1 along the III-III line of FIG. 1.

The outboard motor 1 includes a buffer member 18, a first bolt 19 and a first nut 20, a housing 21, and a high-elasticity member 22 (see FIG. 3). The buffer member 18 is joined to the lower bracket 17 by the first bolt 19 and the first nut 20, for example. Also, the buffer member 18 is held by the housing 21 and the upper case 10. Therefore, the upper case 10 and the lower bracket 17 are joined to each other via the buffer member 18. The first bolt 19 and the first nut 20 are an example of a sandwiching member according to a preferred embodiment of the present invention. Also, the head portion 19*b* of the first bolt 19 and the first nut 20 are an example of a pair of sandwiching portions according to a preferred embodiment of the present invention. Also, the high-elasticity member 22 is an example of a second elastic member according to a preferred embodiment of the present invention. The housing 21 and the upper case 10 are an example of a first member according to a preferred embodiment of the present invention.

The buffer member 18 preferably has a multiple element structure including a plurality of tubular bodies with different diameters fit coaxially, for example. Specifically, as shown in FIG. 3, the buffer member 18 includes an inner sleeve 23, a tubular low-elasticity member 24, and an outer sleeve 25. The low-elasticity member 24 is an example of a first elastic member according to a preferred embodiment of the present invention. The low-elasticity member 24 is fitted to the outer periphery of the inner sleeve 23. Also, the outer sleeve 25 is fitted to the outer periphery of the low-elasticity member 24. The inner peripheral surface and the outer peripheral surface of the lower-elasticity member 24 are fixed to the inner sleeve 23 and the outer sleeve 25, respectively, by, for example, adhesive bonding. Therefore, the inner sleeve 23 and the outer sleeve 25 are joined coaxially via the low-elasticity member 24.

The inner sleeve 23 is arranged along the front-rear direction X1. The inner sleeve 23 has an axial length longer than that of the outer sleeve 25. Most of the outer peripheral surface of the inner sleeve 23 is covered by the inner peripheral portion of the lower-elasticity member 24. The low-elasticity member 24 is preferably made of an elastic material such as resin or rubber. In the present preferred embodiment, the low-elasticity member 24 is preferably made of a natural rubber-based elastic material. Also, the outer sleeve 25 is arranged on the rear end side of the inner sleeve 23 with respect to the front-rear direction X1. The outer sleeve 25 is held by the upper case 10 and the housing 21 while being sandwiched from the right and left by the upper case 10 and the housing 21.

Also, the lower bracket 17 has a through hole 17*a* which penetrates through the lower bracket 17 in the front-rear direction. The buffer member 18 is arranged at the rear of the through hole 17*a*. The front end of the inner sleeve 23 is engaged with the lower bracket 17 via the first plate 26. Also, the inner periphery of the inner sleeve 23 communicates with the through hole 17*a*. The shaft portion 19*a* of the first bolt 19 is inserted through the through hole 17*a* and the inner periphery of the inner sleeve 23 from the front side. The head portion 19*b* of the first bolt 19 is engaged with the lower bracket 17 via a washer 27. Also, the shaft portion 19*a* of the first bolt 19 projects rearward from the rear end of the inner sleeve 23. To this projecting portion, the first nut 20 is attached. The first nut 20 has a flat end face 20*a* (rear face). The end surface 20*a* of the first nut 20 is arranged at the rear of the shaft portion 19*a* of the first bolt 19. The first nut 20 is an example of a first end portion of the sandwiching member according to a preferred embodiment of the present invention.

The first nut 20 presses the rear end of the inner sleeve 23 forward via a second plate 28. The lower bracket 17 and the inner sleeve 23 are sandwiched in the front-rear direction by the head portion 19*b* of the first bolt 19 and the first nut 20. Accordingly, the lower bracket 17 and the inner sleeve 23 are fastened together. Specifically, the buffer member 18 is joined to the lower bracket 17 by the first bolt 19 and the first nut 20.

Next, an arrangement of the housing 21 will be described with reference to FIG. 3 and FIG. 4.

Figure 4:
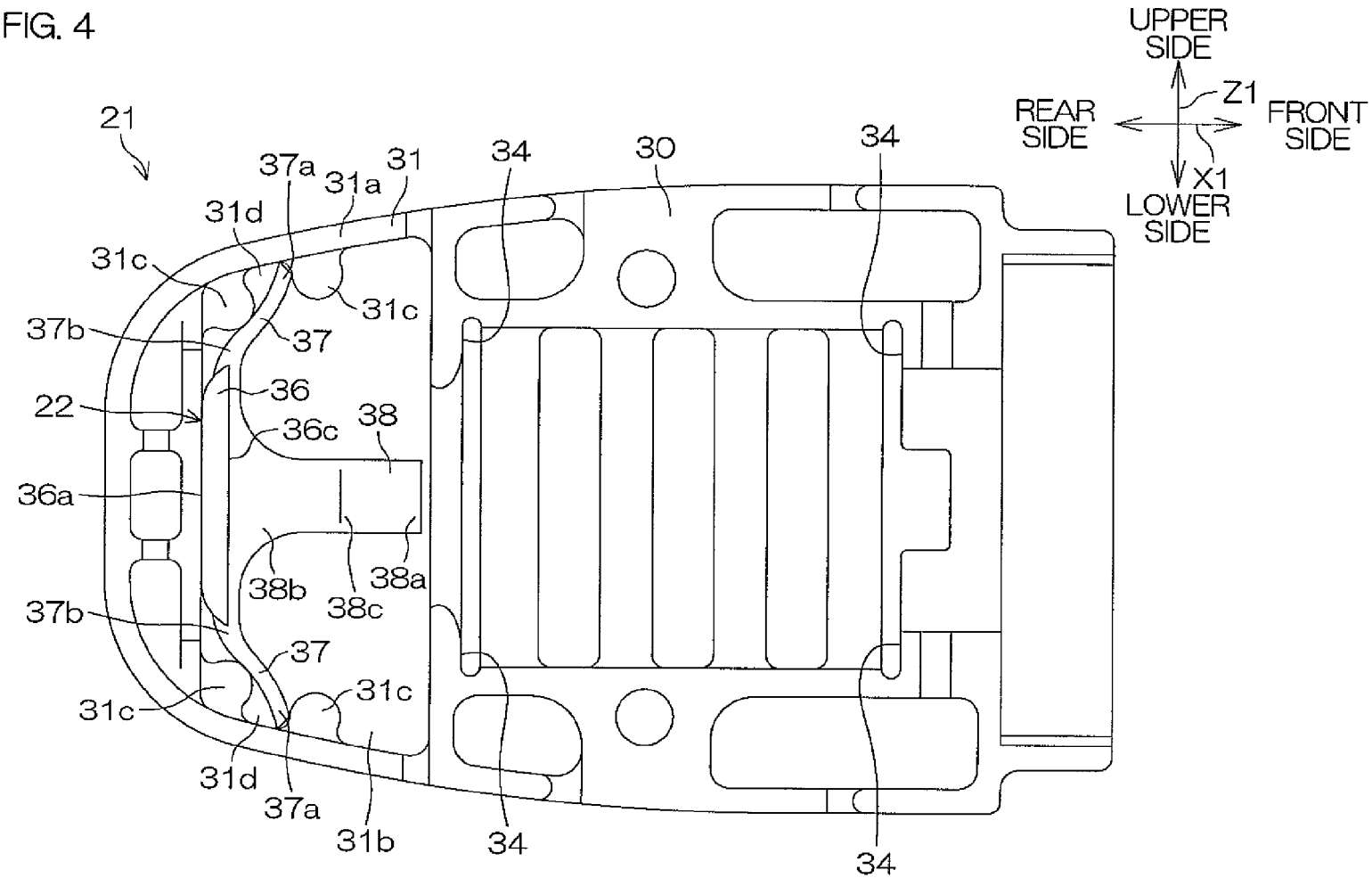
FIG. 4 is a view showing a housing according to a preferred embodiment of the present invention from the inside.

FIG. 4 is a view of the housing 21 from the inside.

The housing 21 is fitted to the upper case 10 from the lateral side. The buffer member 18, the first nut 20, and the high-elasticity member 22 are arranged between the housing 21 and the upper case 10. The housing 21 is fixed to the upper case 10 by a plurality of second bolts 29 (see FIG. 1) while sandwiching these members with the upper case.

The housing 21 includes a first sleeve holding portion 30 arranged to hold the outer sleeve 25, and a first elastic member holding portion 31 arranged to hold the high-elasticity member 22. Also, the upper case 10 includes a second sleeve holding portion 32 corresponding to the first sleeve holding portion 30, and a second elastic member holding portion 33 corresponding to the first elastic member holding portion 31. The housing 21 is fitted to the upper case 10 such that the first sleeve holding portion 30 and the first elastic member holding portion 31 are opposed to the second sleeve holding portion 32 and the second elastic member holding portion 33, respectively.

As shown in FIG. 3, the outer sleeve 25 is held by being sandwiched from the left and right by the first and second sleeve holding portions 30 and 32. Also, the outer sleeve 25 is held in a state in which it is restricted from moving forward and rearward with respect to the housing 21. Further, the outer sleeve 25 is held in a state in which it is restricted from moving forward and rearward with respect to the upper case 10.

In detail, as shown in FIG. 3, the housing 21 includes two first opposed surfaces 34 opposed to each other on the front and rear sides across the outer sleeve 25. The outer sleeve 25 is held by the first and second sleeve holding portions 30 and 32 in a state in which the front end and the rear end of the outer sleeve 25 engage with the two first opposed surfaces 34, respectively. Accordingly, the outer sleeve 25 is held in a state in which it is restricted from moving forward and rearward with respect to the housing 21.

Similarly, as shown in FIG. 3, the upper case 10 includes two second opposed surfaces 35 opposed to each other on the front and rear sides across the outer sleeve 25. The outer sleeve 25 is held by the first and second sleeve holding portions 30 and 32 in a state in which the front end and the rear end of the outer sleeve 25 engage with the two second opposed surfaces 35, respectively. Accordingly, the outer sleeve 25 is held while being restricted from moving forward and backward with respect to the upper case 10.

Further, as shown in FIG. 3, the first nut 20 and the high-elasticity member 22 are arranged between the first and second elastic member holding portions 31 and 33. The first nut 20 is opposed to a portion of the upper case 10 and a portion of the housing 21 in the front-rear direction across the high-elasticity member 22. The high-elasticity member 22 is held by the first and second elastic member holding portions 31 and 33 so as to be opposed to the first nut 20 in the front-rear direction across a gap. The portions of the upper case 10 and the housing 21, opposed to the first nut 20 across the high-elasticity member 22, are protected from the first nut 20 by the high-elasticity member 22.

Next, the arrangement of the high-elasticity member 22 will be described with reference to FIG. 4 to FIG. 7.

Figure 5:
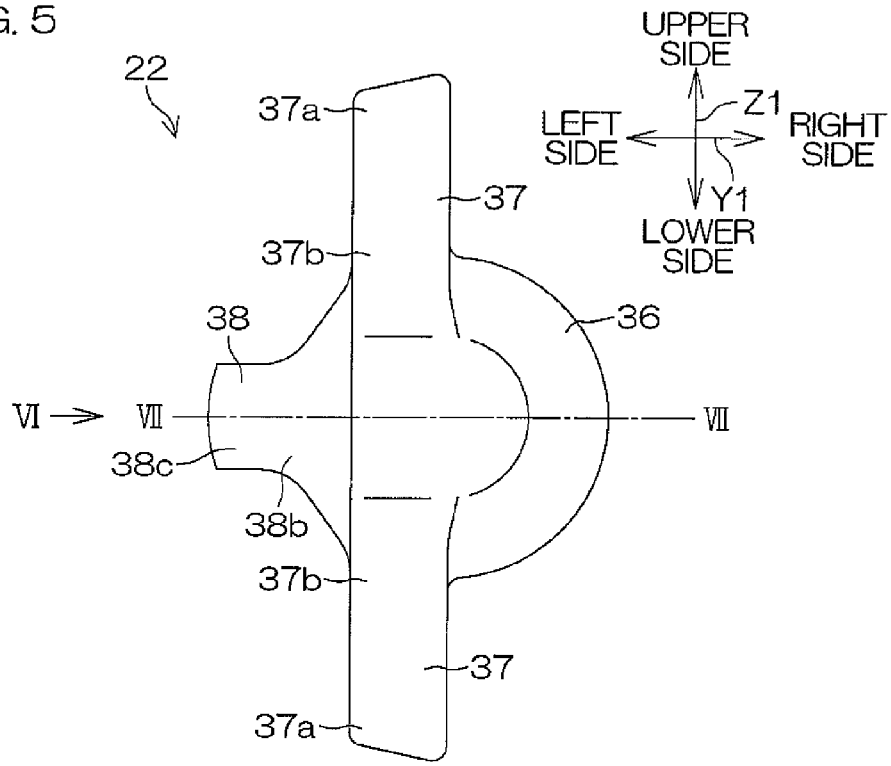
FIG. 5 is a view of a high-elasticity member according to a preferred embodiment of the present invention from the rear side.
Figure 6:
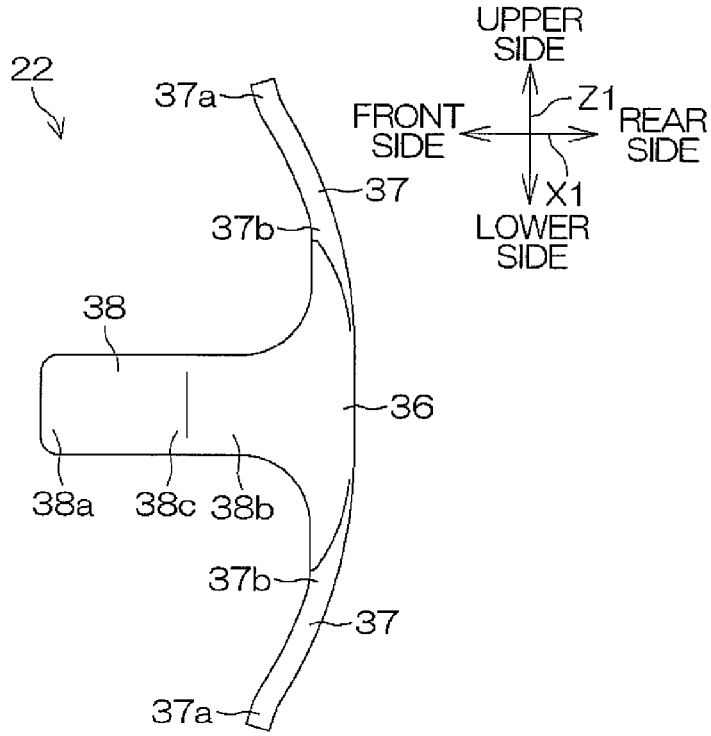
FIG. 6 is a view of the high-elasticity member according to a preferred embodiment of the present invention from the left side.
Figure 7:
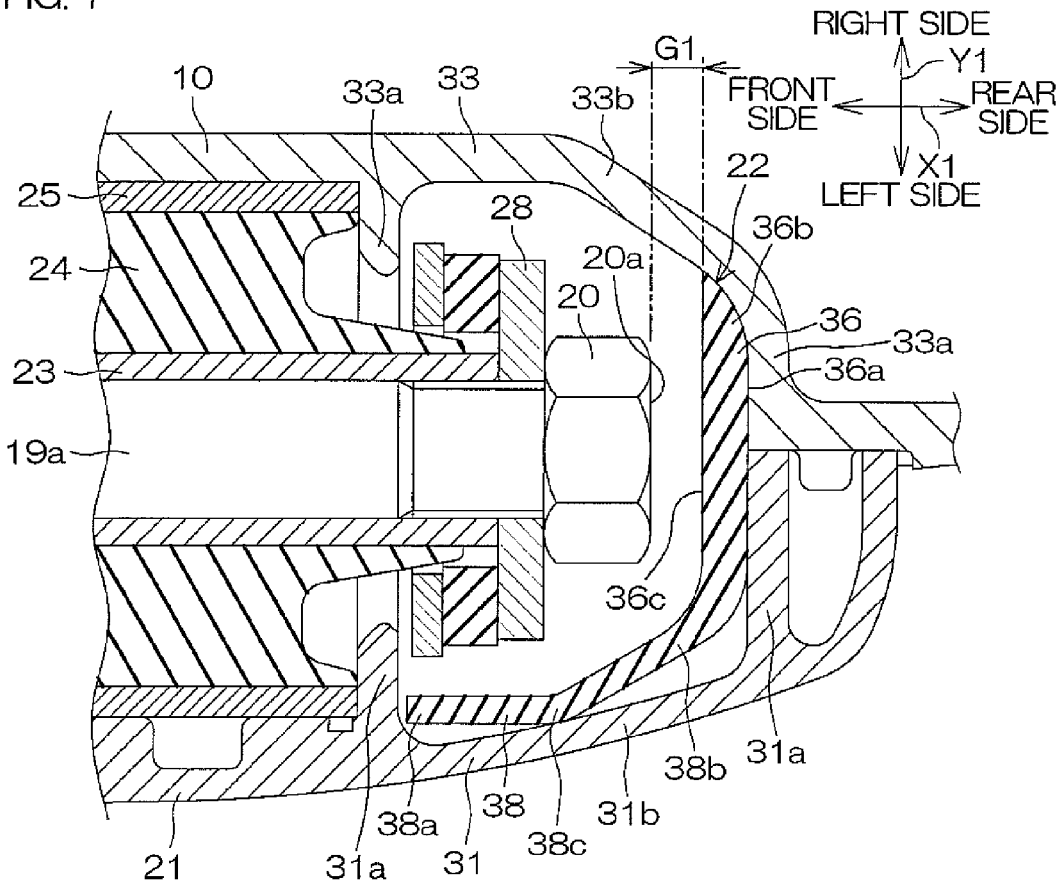
FIG. 7 is an enlarged view of a portion of FIG. 3.

FIG. 5 is a view of the high-elasticity member 22 from the rear side. Also, FIG. 6 is a view of the high-elasticity member 22 from the left side. Also, FIG. 7 is an enlarged view of a portion of FIG. 3. FIG. 6 is equivalent to a view of the high-elasticity member 22 in the arrow VI direction of FIG. 5. The section of the high-elasticity member 22 shown in FIG. 7 is the section along the VII-VII line of FIG. 5.

The high-elasticity member 22 preferably is integrally made of an elastic material such as urethane rubber, for example. The high-elasticity member 22 has an elastic modulus higher than that of the low-elasticity member 24. As shown in FIG. 5, the high-elasticity member 22 includes a disk portion 36 and a plurality (for example, three) of leg portions 37 and 38. The disk portion 36 is an example of an opposed portion according to the preferred embodiment of the present invention. The three leg portions 37 and 38 are an example of a fixed portion according to a preferred embodiment of the present invention.

As shown in FIG. 6, the three leg portions 37 and 38 extend to one side of the disk portion 36 while expanding outward from the outer peripheral portion of the disk portion 36. As shown in FIG. 5, the three leg portions 37 and 38 include two leg portions 37 extending substantially up and down, and one leg portion 38 arranged so as to be perpendicular or substantially perpendicular to the two leg portions 37 when the high-elasticity member 22 is viewed from the rear side. The two leg portions 37 are arranged symmetrically in the up-down direction across the disk portion 36.

The leg portions 37 and 38 are curved so as to protrude substantially outward of the disk portion 36. In detail, as shown in FIG. 6, each of the two leg portions 37 includes a first tip end portion 37*a* and a first root portion 37*b*. The portions except for the first tip end portions 37*a* of the two leg portions 37 are curved in an arc shape so as to protrude outward. The first root portions 37*b* of the two leg portions 37 are smoothly continued to the outer peripheral portion of the disk portion 36. Also, the first tip end portions 37*a* of the two leg portions 37 are warped slightly outward with respect to other portions.

On the other hand, as shown in FIG. 6, the leg portion 38 includes a second tip end portion 38*a*, a second root portion 38*b*, and a second angled portion 38*c*. As shown in FIG. 7, the second root portion 38*b* of the leg portion 38 is curved in an arc shape so as to smoothly continue to the outer peripheral portion of the disk portion 36. Also, the tip portion from the second angled portion 38*c* of the leg portion 38 is arranged to be parallel or substantially parallel to the direction perpendicular to the disk portion 36. As shown in FIG. 4 and FIG. 7, the high-elasticity member 22 has a shape and configuration extending along the inner surfaces of the housing 21 and the upper case 10 as a whole. The high-elasticity member 22 is fixed to the housing 21 in a state in which the high-elasticity member extends along the inner surfaces of the housing 21 and the upper case 10.

Next, a fixation structure of the high-elasticity member 22 will be described with reference to FIG. 4 and FIG. 8.

The first elastic member holding portion 31 provided on the housing 21 preferably has a box shape opened to the upper case 10 side. The first elastic member holding portion 31 includes a first peripheral wall 31*a* (see FIG. 4) having a substantially quadrilateral shape, a first side wall 31*b* (see FIG. 7) joined to the first peripheral wall 31*a*, and a plurality (for example, four) of protrusions 31*c* (see FIG. 4) provided on the first peripheral wall 31*a*. Also, as shown in FIG. 7, the second elastic member holding portion 33 provided on the upper case 10 preferably has a recess shape opened to the housing 21 side. The second elastic member holding portion 33 includes a second peripheral wall 33*a* and a second side wall 33*b*.

As shown in FIG. 4, the four protrusions 31*c* provided on the first elastic member holding portion 31 are arranged on the inner surface of the first peripheral wall 31*a* while being divided into the upper side and the lower side. The upper two protrusions 31*c* and the lower two protrusions 31*c* are opposed to each other in the up-down direction. Between the upper two protrusions 31*c*, a recess portion 31*d* is provided. Similarly, a recess portion 31*d* is provided between the lower two protrusions 31*c*.

The high-elasticity member 22 is held by the first elastic member holding portion 31 such that the disk portion 36 is positioned on the rear side of the three leg portions 37 and 38. In detail, as shown in FIG. 7, a portion of the rear surface 36*a* of the disk portion 36 is in surface contact with the rear portion of the first peripheral wall 31*a* from the front side. Specifically, the disk portion 36 is supported from the rear side by the first peripheral wall 31*a*. Also, as shown in FIG. 4, the first tip end portion 37*a* of one of the leg portions 37 is inserted in the upper recess portion 31*d*. Similarly, the first tip end portion 37*a* of the other leg portion 37 is inserted in the lower recess portion 31*d*. The first tip end portions 37*a* of the two leg portions 37 are engaged with the front two protrusions 31*c* from the rear side. Further, the first tip end portions 37*a* of the two leg portions 37 are engaged with the inner surface of the first peripheral wall 31*a* from the upper side and the lower side, respectively. As shown in FIG. 7, the leg portion 38 is arranged along the first side wall 31*b*. The second angled portion 38*c* of the leg portion 38 is engaged with the first side wall 31*b* from the right side.

Also, the high-elasticity member 22 is held by being sandwiched from the right and left by the upper case 10 and the housing 21. In detail, as shown in FIG. 7, a portion of the rear surface 36*a* of the disk portion 36 is in surface contact with the rear portion of the second peripheral wall 33*a* from the front side. Specifically, the disk portion 36 is supported from the rear side by the second peripheral wall 33*a*. The second peripheral wall 33*a* is an example of a supporting portion according to the preferred embodiment of the present invention. The rear surface 36*a* of the disk portion 36 is an example of a supported portion according to a preferred embodiment of the present invention. Also, as shown in FIG. 7, the portion 36*b* positioned closest to the upper case 10 of the outer peripheral portion of the disk portion 36 is engaged with the second side wall 33*b* from the left side. Accordingly, the high-elasticity member 22 is held by being sandwiched from the right and left by the upper case 10 and the housing 21. The disk portion 36 of the high-elasticity member 22 has a flat front surface 36*c* (surface opposed to the first nut 20). In a state in which a propulsive force generated by the propeller 7 is not applied to the upper case 10 (the state shown in FIG. 7), the front surface 36*c* of the disk portion 36 is opposed in parallel to the end face 20*a* of the first nut 20 across a predetermined gap G1 in the front-rear direction.

The high-elasticity member 22 is restricted from moving forward and rearward with respect to the housing 21 by the engagement between the rear surface 36*a* of the disk portion 36 and the first peripheral wall 31*a* and the engagement between the first tip end portions 37*a* of the two leg portions 37 and the two protrusions 31*c*. The rear surface 36*a* of the disk portion 36 and the first tip end portions 37*a* of the two leg portions 37 are an example of a pair of front-rear engagement portions according to a preferred embodiment of the present invention. Also, the high-elasticity member 22 is restricted from moving leftward and rightward with respect to the upper case 10 and the housing 21 by the engagement between the portion 36*b* of the outer peripheral portion of the disk portion 36 and the second side wall 33*b*, and the engagement between the second angled portion 38*c* of the leg portion 38 and the first side wall 36*b*. The portion 36*b* of the outer peripheral portion of the disk portion 36 and the second angled portion 38*c* of the leg portion 38 are an example of a pair of left-right engagement portions according to a preferred embodiment of the present invention. Also, the high-elasticity member 22 is restricted from moving up and down with respect to the housing 21 by the engagement between the first tip end portion 37*a* of one of the leg portions 37 and the first peripheral wall 31*a* and the engagement between the first tip end portion 37*a* of the other leg portion 37 and the first peripheral wall 31*a*. The first tip end portions 37*a* of the two leg portions 37 are an example of a pair of up-down engagement portions according to a preferred embodiment of the present invention.

Thus, the high-elasticity member 22 is restricted from moving forward and rearward, leftward and rightward, and up and down with respect to the upper case 10 and the housing 21. Accordingly, the high-elasticity member 22 is reliably fixed to the housing 21. Therefore, the portions opposed to the first nut 20 of the upper case 10 and the housing 21 are protected by the high-elasticity member 22 for a long period of time. Also, as compared to a case in which the high-elasticity member 22 is fixed to the upper case 10, attachment of the housing 21 to the upper case 10 is easy.

Next, with reference to FIG. 3, transmission of a propulsive force in the lower-side mount structure will be described.

A forward propulsive force generated by the propeller 7 is applied to the upper case 10 via the lower case 11. When the forward propulsive force is small, this propulsive force is transmitted to the lower bracket 17 via the low-elasticity member 24. On the other hand, when the forward propulsive force is great, the propulsive force is transmitted to the lower bracket 17 via the high-elasticity member 22 in addition to the low-elasticity member 24.

In detail, when the forward propulsive force is applied to the upper case 10, the rear second opposed surface 35 of the two second opposed surfaces 35 provided on the upper case 10 presses the outer sleeve 25 forward. Also, the forward propulsive force applied to the upper case 10 is transmitted to the housing 21 fixed to the upper case 10. Therefore, the rear first opposed surface 34 of the two first opposed surfaces 34 provided on the housing 21 presses the outer sleeve 25 forward.

As described above, in a state in which no propulsive force is applied to the upper case 10, the disk portion 36 of the high-elasticity member 22 is opposed to the first nut 20 across a predetermined gap G1 in the front-rear direction X1 as a direction of action of the propulsive force. Therefore, when the engine 4 rotates at a low speed and the forward propulsive force applied to the upper case 10 is small, the propulsive force is transmitted from the upper case 10 and the housing 21 to the outer sleeve 25 in the state in which the high-elasticity member 22 and the first nut 20 are spaced from each other. Then, the forward propulsive force transmitted to the outer sleeve 25 is transmitted to the lower bracket 17 via the low-elasticity member 24 and the inner sleeve 23. Accordingly, the forward propulsive force is transmitted to the hull to move the hull forward. At this time, vibration of the upper case 10 (vibration caused by, for example, the rotation of the engine 4) is absorbed mainly by the low-elasticity member 24.

On the other hand, when the engine 4 rotates at a high speed and the forward propulsive force applied to the upper case 10 is great, the force to be transmitted from the outer sleeve 25 to the low-elasticity member 24 is great. Therefore, elastic deformation of the low-elasticity member 24 in the front-rear direction X1 increases and the outer sleeve 25 moves forward together with the upper case 10 and the housing 21 with respect to the inner sleeve 23. Therefore, the displacement amount of the upper case 10 (forward displacement amount) with respect to the lower bracket 17 increases and the high-elasticity member 22 comes closer to the first nut 20. Then, when the displacement amount of the upper case 10 reaches a threshold (predetermined gap G1), the front surface 36*c* of the disk portion 36 of the high-elasticity member 22 comes into contact with the end surface 20*a* of the first nut 20. Therefore, the forward propulsive force applied to the upper case 10 is transmitted from the low-elasticity member 24 to the lower bracket 17 via the inner sleeve 23, and also transmitted to the first nut 20 via the high-elasticity member 22. Then, the forward propulsive force transmitted to the first nut 20 is transmitted to the lower bracket 17 via the inner sleeve 23. Accordingly, the forward propulsive force is transmitted to the hull to move the hull forward.

As described above, in the present preferred embodiment, in a state in which the engine 4 rotates at a low speed and the propulsive force is small, the propulsive force is transmitted from the upper case 10 to the lower bracket 17 via the low-elasticity member 24. Therefore, in this state, vibration of the upper case 10 is sufficiently absorbed. On the other hand, in a state in which the engine 4 rotates at a high speed and the propulsive force is great, the propulsive force is transmitted from the upper case 10 to the lower bracket 17 via the high-elasticity member 22 in addition to the low-elasticity member 24. Therefore, in this state, the ratio of the propulsive force to be absorbed by the elastic member to the propulsive force generated by the propeller 7 is small. Therefore, the propulsive force is efficiently transmitted. Thus, joining between the upper case 10 and the lower bracket 17 is switched between a state enabling sufficient absorption of vibration and a state enabling efficient transmission of the propulsive force according to a change in displacement amount of the upper case 10 with respect to the lower bracket 17 across the threshold (predetermined gap G1). Accordingly, joining between the upper case 10 and the lower bracket 17 is switched corresponding to the rotation speed of the engine 4.

Also, in the present preferred embodiment, the high-elasticity member 22 is restricted from moving forward and rearward, leftward and rightward, and up and down with respect to the upper case 10 and the housing 21 by the engagements between the high-elasticity member 22 and the upper case 10 and the housing 21. Accordingly, the high-elasticity member 22 is reliably fixed to the housing 21. Further, the high-elasticity member 22 is arranged along the inner surfaces of the housing 21. Therefore, the high-elasticity member 22 is restricted from moving with respect to the housing 21 and the upper case 10 by the engagements between the high-elasticity member 22 and the housing 21 and the upper case 10. Accordingly, the high-elasticity member 22 is more reliably fixed to the housing 21. Therefore, the risk of coming-off of the high-elasticity member 22 from the housing 21 is very small. Therefore, the above-described effect is reliably obtained for a long period of time.

In the present preferred embodiment, by fixing the three leg portions 37 and 38 of the high-elasticity member 22 to the housing 21, the entire high-elasticity member 22 is fixed to the housing 21. Accordingly, the high-elasticity member 22 is prevented from coming off the housing 21. Also, the portion (disk portion 36) opposed to the first nut 20 and the portion (three leg portions 37 and 38) fixed to the housing 21 are divided, so that the high-elasticity member 22 is easily manufactured. In detail, the leg portions 37 and 38 are not required to have high dimensional accuracy as long as they are arranged to fix the disk portion 36 at predetermined positions. Therefore, the high-elasticity member 22 is easily manufactured. Further, by arranging the leg portions 37 and 38 to fix the disk portion 36 at a predetermined position and increasing the dimensional accuracy of the disk portion 36, the size of the predetermined gap G1 can be accurately controlled. Accordingly, joining between the upper case 10 and the lower bracket 17 is more accurately switched.

In the present preferred embodiment, the high-elasticity member 22 is preferably supported on the upper case 10 from the side opposite to the first nut 20. Therefore, when the high-elasticity member 22 and the first nut 20 come into contact with each other, the high-elasticity member 22 is sandwiched by the upper case 10 and the first nut 20. In this state, a forward propulsive force is transmitted from the upper case 10 to the first nut 20 via the high-elasticity member 22. Accordingly, a propulsive force is accurately transmitted from upper case 10 to the first nut 20. Therefore, the propulsive force generated by the propeller 7 is more efficiently transmitted.

A preferred embodiment of the present invention is described above, and the present invention is not limited to the contents of the preferred embodiment described above, but can be variously changed within the scope of claims. For example, in the preferred embodiment described above, the high-elasticity member 22 is preferably provided with three leg portions 37 and 38, for example. However, the number of leg portions may be two or less, or four or more, for example. Also, the leg portions 37 may be arranged to function as left-right engagement portions by contact with the upper case 10, for example. Also, the leg portion may be arranged to have a tubular shape joined to the entire periphery of the outer peripheral portion of the disk portion 36.

Also, in the preferred embodiment described above, the high-elasticity member 22 is preferably fixed to the housing 21. However, the high-elasticity member 22 may be fixed to the upper case 10. Also the high-elasticity member 22 may be fixed to the housing 21 and the upper case 10.

Also, in the preferred embodiment described above, the end surface 20*a* of the first nut 20 is preferably arranged at the rear of the shaft portion 19*a* of the first bolt 19. However, an end portion of the shaft portion 19*a* may be arranged at the rear of the end surface 20*a* of the first nut 20. In this case, the end portion of the shaft portion 19*a* is an example of a first end portion of the sandwiching member according to a preferred embodiment of the present invention.

Also, in the preferred embodiment described above, the present invention is preferably applied to the lower-side mount structure of the outboard motor 1. However, the present invention may be applied to the upper-side mount structure of the outboard motor 1.

The present application corresponds to Japanese Patent Application No. 2009-251058 filed in the Japan Patent Office on Oct. 30, 2009, and the entire disclosure of this application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A mount structure of an outboard motor, the mount structure comprising:

a first member arranged such that a propulsive force generated by a propeller of the outboard motor is applied to the first member;

a second member arranged such that the propulsive force is transmitted to the second member via the first member;

a buffer member including a tubular outer sleeve fixed to the first member, a tubular inner sleeve disposed in the outer sleeve, and a first elastic member fixed to an inner peripheral surface of the outer sleeve and an outer peripheral surface of the inner sleeve, the inner sleeve and the second member being arranged in a direction of action of the propulsive force;

a sandwiching member including a first end portion positioned on the inner sleeve side and at least a pair of sandwiching portions arranged to sandwich the second member and the inner sleeve in the direction of action of the propulsive force; and a second elastic member having an elastic modulus higher than an elastic modulus of the first elastic member, the second elastic member fixed to the first member, the second elastic member opposed to the first end portion of the sandwiching member across a gap in the direction of action of the propulsive force.

2. The mount structure of an outboard motor according to claim 1, wherein the second elastic member includes:

a pair of front-rear engagement portions arranged to engage with the first member from a front side and a rear side;

a pair of left-right engagement portions arranged to engage with the first member from a left side and a right side; and a pair of up-down engagement portions arranged to engage with the first member from an upper side and a lower side.

3. The mount structure of an outboard motor according to claim 1, wherein the second elastic member is arranged along an inner surface of the first member.

4. The mount structure of an outboard motor according to claim 1, wherein the second elastic member includes an opposed portion arranged to be opposed to the first end portion of the sandwiching member, and a fixed portion fixed to the first member.

5. The mount structure of an outboard motor according to claim 1, wherein the first member includes a supporting portion arranged to be opposed to the first end portion of the sandwiching member across the second elastic member, and the second elastic member includes a supported portion supported by the supporting portion.

6. The mount structure of an outboard motor according to claim 1, wherein the second elastic member is made of an integral elastic material.

7. The mount structure of an outboard motor according to claim 1, wherein the first member includes an upper case arranged such that the propulsive force is applied to the upper case, and a housing attached to the upper case such that the buffer member is covered by the housing, and the second elastic member is fixed to the housing.

* * * * *